US010047575B2

(12) United States Patent
Tveter

(10) Patent No.: US 10,047,575 B2
(45) Date of Patent: Aug. 14, 2018

(54) PIPE GRIPPER

(71) Applicant: TOTECH INDUSTRIUTVECKLING AB, Billingsfors (SE)

(72) Inventor: Tommy Tveter, Amal (SE)

(73) Assignee: Totech Industriutveckling AB (SE)

( * ) Notice: Subject to any disclaimer, the term of this patent is extended or adjusted under 35 U.S.C. 154(b) by 121 days.

(21) Appl. No.: 15/034,137

(22) PCT Filed: Nov. 4, 2014

(86) PCT No.: PCT/EP2014/073710
§ 371 (c)(1),
(2) Date: May 3, 2016

(87) PCT Pub. No.: WO2015/063329
PCT Pub. Date: Jul. 5, 2015

(65) Prior Publication Data

US 2016/0273283 A1 Sep. 22, 2016

(30) Foreign Application Priority Data

Nov. 4, 2013 (SE) ..... 1351306

(51) Int. Cl.
*E21B 19/06* (2006.01)
*E21B 19/16* (2006.01)

(52) U.S. Cl.
CPC ..... *E21B 19/06* (2013.01); *E21B 19/16* (2013.01); *E21B 19/161* (2013.01)

(58) Field of Classification Search
CPC ..... E21B 19/06; E21B 19/16; E21B 19/161
See application file for complete search history.

(56) References Cited

U.S. PATENT DOCUMENTS 1,531,377 A 3/1925 Clarke
2003/0118400 A1 6/2003 Hagen

FOREIGN PATENT DOCUMENTS

AU 179 261 B2 5/2000
WO 2009/031166 A1 3/2009

OTHER PUBLICATIONS

International Search Report issued in International Application No. PCT/EP2014/073710 dated Oct. 23, 2015.

*Primary Examiner* — Yong-Suk Ro
(74) *Attorney, Agent, or Firm* — Eric L. Sophir; Dentons US LLP

(57) ABSTRACT

A gripper for gripping a pipe (P) has gripping bodies holding devices, and dies, the dies being fastened to respective holding devices that are fastened to respective gripping bodies with respective connection arrangements. The connection arrangements can be maneuvered to release the respective holding device for the holding device to assume a service position held by the respective gripping body. A die locking device of a holding device is adapted to be kept, by contact with the respective gripping body, in a locking position when holding device is in the operation position. The locking device can move to an open position when the holding device is moved away from the operation position. The die and a seat in the holding device have a notch and a protrusion, arranged so that, as the pipe contacting element is inserted into the seat in an insertion direction, the protrusion enters, in parallel with the insertion direction, into the notch.

12 Claims, 8 Drawing Sheets

PIPE GRIPPER

CROSS-REFERENCE TO RELATED APPLICATIONS

This application claims priority to PCT/EP2014/073710, filed Nov. 4, 2014, which claims priority to Swedish Patent Application No. 1351306-4, filed Nov. 4, 2013, all of which are incorporated by reference in their entirety.

TECHNICAL FIELD

The invention relates to a gripper for gripping a pipe, comprising a plurality of gripping bodies and a plurality of pipe contacting devices. Each pipe contacting device is, when the gripper is in use, fastened to one of the gripping bodies. Each of the pipe contacting devices can comprise a holding device, herein also referred to as a jaw, and at least one pipe contacting element, herein also referred to as a die. The gripper is adapted to move the gripping bodies in relation to each other so as to grip a pipe, whereby the pipe contacting elements are in contact with the pipe, or so as to release to the pipe.

BACKGROUND OF THE INVENTION

Grippers are traditionally used in conjunction with drilling in the ground or seabed for assembling and disassembling drill strings and borehole casings. The drill strings and the casings are made up of pipes, and two grippers can be used to grip a respective pipe to connect or disconnect the pipes at complementary threads in the pipes.

The dies, or inserts as they are also sometimes referred to, are the parts that are in direct contact with the pipes. They can have a surface presenting a curvature that is identical to the curvature of the pipe to be gripped. The dies often need to be replaced, due for example to a change of pipe diameter, or to wear of the dies. When such die changing is carried out during a drilling or a borehole preparation process, there a risk that loose parts, such as bolts falls into the borehole, which can cause severe problems.

US2003118400 suggests, where each die is inserted in a dovetail slot, providing a locking bracket in a further dovetail slot arranged perpendicularly to the dovetail slot for the die. The locking bracket can be displaced from a position wherein the die is locked by the locking bracket to a position where the die can be moved passed the locking bracket. For this a screw needs to be tightened, to keep the locking bracket in the locking position, and released when the die is to be replaced. However, there is nevertheless a risk that an operator makes a mistake when handling the locking device. More generally, there is a desire to further reduce the risks of errors and mistakes when the dies are replaced. This includes the risk that the operator makes a mistake when inserting replacement dies, which can damage the equipment.

SUMMARY

It is an object of the invention to reduce the risks of errors and mistakes when pipe contacting elements, or dies, are replaced in a gripper for gripping pipes.

It is also an object of the invention to facilitate and simplify the operation of replacing pipe contacting elements, or dies, in a gripper for gripping pipes.

The objects are reached with a first aspect of the invention providing a gripper for gripping a pipe, comprising a plurality of gripping bodies and holding devices, each holding device being, when the gripper is in use, fastened to one of the gripping bodies with a respective connection arrangement in an operation position relative to the respective gripping body, the gripper further comprising a plurality of pipe contacting elements, each holding device holding, when the gripper is in use, at least one of the pipe contacting elements, the gripper being adapted to move the gripping bodies in relation to each other so as to grip a pipe, whereby the pipe contacting elements are in contact with the pipe, or so as to release to the pipe, characterized in that at least one, preferably each, of the connection arrangements is adapted to be maneuvered so as to release the respective holding device from the operation position so as for the holding device to assume a service position in which it is displaced from the operation position and held by the respective gripping body.

It should be noted that there could be one holding device for each gripping body, or there could be more than one holding device for a respective of one or more of the gripping bodies. Preferably, in the operation position the holding device is countersunk into a depression in the gripping body, which depression has a shape that is complementary to the external shape of the holding device. Thereby, very large lateral forces occurring at the time of threading two pipes together, can be effectively transferred between the holding device and the gripping body. Preferably, in the service position, the holding device is displaced from the operation position in a direction away from the gripping body. Thereby, in the service position the holding device is displaced and away from the countersunk location, so that it is at least partially emerged from the depression.

Preferably the pipe contacting elements, or dies, can be replaced in the in the service position of the holding device. Since the holding device can be held, during a die replacement procedure, by the gripping body in the service position, the complete removal of the holding device from the gripping body is eliminated. This reduces the risk of mistakes during the die replacement process. For example, the risk that the holding device is dropped by mistake into the borehole, which can create severe problems, is greatly reduced. Nevertheless, the connection arrangement can be adapted so that by an additional action by an operator, for example dismounting of the elongated fixing device described below, the holding device can be completely removed from the gripping body.

Preferably, all of the connection arrangements are adapted to be maneuvered so as to release the respective holding device from the operation position so as for the holding device to assume a service position in which it is held by the respective gripping body.

Preferably, each connection arrangement is adapted to engage the respective gripping body, whereby the connection device is adapted to support the holding device in the service position. Thus, the holding device can be held by the connection arrangement. More specifically, the holding device can be held by the gripping body via the connection arrangement.

Each connection arrangement may comprise a turnable member adapted to lock, by engagement with the gripping body, the holding device in the operation position, the turnable member further being adapted to be turned and thereby release the holding device from the operation position, whereby the holding device can move from the operation position to the service position.

The turnable member preferably presents an abutment surface and is arranged so that the abutment surface can assume a blocking position in which it prevents the holding device from moving away from the operation position, the turnable member further being arranged so that upon turning the turnable member the abutment surface moves away from the blocking position thereby allowing the holding device to move away from the operation position. Thereby, the holding device can move into the service position.

Each connection arrangement may comprise a fixing device, which may be elongated, extending through an aperture, e.g. a hole, in the holding device and being engaged with the gripping body.

In some embodiments the turnable member is a sleeve through which the fixing device extends, the fixing device being fixed to the gripping body. In other embodiments, the turnable member is the fixing device, i.e. these two parts are integrated into one device.

The fixing device is preferably arranged to support the holding device in the service position. Thereby, where the fixing device is elongated, the holding device can be arranged to be moved from the operation position to the service position along a longitudinal axis of the fixing device. Thus, the fixing device can be arranged to extend in a cantilevered manner from the gripping body, whereby it can hold or support the holding device in the service position.

Preferably, the connection arrangement comprises an elongated fixing device, and a sleeve into which the fixing device is inserted, the fixing device being inserted through an aperture in the holding device and fixed to the gripping body, the fixing device presents a first flange, the sleeve being adapted to bear against the first flange so as to axially, i.e. in the longitudinal direction of the fixing device, restrict the movement of the sleeve, one of the sleeve and the holding device presents a first abutment surface, and the other of the sleeve and the holding device presents a second abutment surface and a third abutment surface, the second abutment surface and the third abutment surface being mutually displaced in the axial direction and in the circumferential direction of the sleeve, the first abutment surface is adapted to abut, upon the sleeve assuming a first angular position, herein also referred to as a blocking position, in relation to the holding device, against the second abutment surface whereby the holding device is locked in, preferably biased into, the operation position, and the first abutment surface is adapted to abut, when the sleeve is turned so as to assume a second angular position, against the third abutment surface whereby the holding device can be moved into the service position.

The elongated fixing device preferably presents a substantially cylindrical external surface. It can for example be a bolt. Alternatively it could be a pin adapted for a bayonet connection. The fixing device is fixed to the gripping body, e.g., where it is a bolt, by being screwed into a threaded hole in the gripping body. The connection arrangement of each holding device can comprise one, two or more elongated fixing devices each inserted through a respective aperture, e.g. hole, in the holding device, and one, two or more sleeves, in each of which a respective of the fixing devices is inserted.

The axial direction of the elongated fixing device is defined as the direction in which it presents is major extension. For example in the case of a bolt, the axial direction of the bolt is the direction in which it translates as it is screwed into a threaded hole. The sleeve has an internal shape of a circular cylinder which encloses the fixing device when the fixing device is inserted into the sleeve, and the axial direction of the sleeve is defined as the axis of the cylinder. The circumferential direction of the sleeve is defined as a direction that is perpendicular to the axial direction of the sleeve and a radial direction of the sleeve.

The first flange of the fixing device, which, in case of a bolt, can be provided by a head of the bolt, restricts the movement of the sleeve, so that the sleeve is interposed between the first flange and the holding device, and the holding device is interposed between the sleeve and the gripping body.

The second abutment surface and the third abutment surface are mutually displaced in the axial direction, meaning that they are at different distances from the first flange of the fixing device. The embodiment provides for the holding device to be biased into the operation position when the first abutment surface abuts against the second abutment surface at a first angular position of the sleeve in relation to the holding device. The angular position of the sleeve is defined as a position in the circumferential direction of the sleeve. When the sleeve is turned, for example by engagement and use of a handheld tool, so as to assume the second angular position in relation to the holding device, which second angular position is different from the first angular position, the first abutment surface abuts against the third abutment surface whereby the holding device can be moved into the service position.

Preferably, the fixing device presents a second flange bearing against the respective gripping body. This will limit the insertion of the fixing device into the gripping body, and it will provide a predetermined distance between the first flange and a region of abutment of the holding device to the gripping body.

Preferably, one of the first abutment surface and the second abutment surface is provided with a notch and the other of the first abutment surface and the second abutment surface is provided with a protrusion, so that, upon engagement of the protrusion with the notch, angular movement of the sleeve is prevented, and the sleeve is kept in the first angular position. Preferably, the protrusion has a shape that is complementary to the notch.

Preferably, an elastic element, for example a wave shaped washer (wave washer), a conical washer (Belleville washer), or a split washer, is provided between the sleeve and the first flange. Thereby, where the first abutment surface and the second abutment surface are provided with a notch and a complementary protrusion, as mentioned above, the protrusion will be biased into the notch. For turning the sleeve, for example by engagement and use of a handheld tool, towards the second angular position, the elastic element can be adapted to be compressed, so that the sleeve can be slightly "lifted" and the protrusion is allowed to exit the notch. For this procedure, the protrusion can be provided with a beveled side so as to facilitate the exit of the protrusion from the notch upon turning the sleeve.

Preferably, at least one of the holding devices comprises a holding body and a locking device, which locking device can assume in relation to the holding body an open position in which a pipe contacting element, held by the holding device, can be removed from the holding device, and a locking position in which the pipe contacting element is locked to the holding device, wherein the locking device is adapted to be kept, by contact with the respective gripping body, in the locking position when the holding device is in the operation position, and that the locking device is free to move to the open position when the holding device is moved away from the operation position.

Thereby, it is secured that the locking device is in the locking position when the holding device is in the operation position. When the gripper is not in use, any pipe contacting element can be removed from its holding device, e.g. to be changed or serviced. For this the holding device is moved away from the operation position, and thereby a distance is created between the holding device and the gripping body, such that the locking device is free to assume the open position, and the pipe contacting element can be removed from the holding device. However, in the operation position of the holding device, the locking device is biased to the locking position by a movement restriction imposed by the gripping body. The locking device can be arranged to protrude, in its open position, from the holding body towards the gripping body, and as the holding device is moved towards the operation position, i.e. towards the gripping body, the gripping body will push the locking device to the locking position.

This will automatically secure that the locking device is in the locking position when the holding device is in the operation position. Thus, no specific action by an operator is needed to lock the pipe contacting element to the holding device. In some embodiments the locking device comprises an elastic element, which is adapted to bias to locking device to the open position. Thus, the locking device will be biased by the gripping body to the locking position when the holding device is in the operation position, and it will be biased by the elastic element to the open position when the holding device is removed from the operation position. Thereby, the locking device will automatically assume the open position, and no specific action is needed by an operator to unlock the pipe contacting element when it is to be removed from the holding device.

Preferably, the locking device is arranged to move, by contact with the respective gripping body, to the locking position as the holding device is moved into the operation position. Preferably, each holding device comprises one locking device for each pipe contacting element. Preferably, all holding devices of the gripper comprise a holding body and a locking device as described above.

In some embodiments the holding device is provided with a seat for holding the pipe contacting element, whereby the pipe contacting element can be inserted into the seat in an insertion direction, the locking device blocking in the locking position the path in the insert direction of the pipe contacting element so as to prevent removal of the pipe contacting element from the seat, and the locking device being in the open position removed from the path in the insert direction of the pipe contacting element so as to allow the removal of the pipe contacting element from the holding device.

Preferably, at least one of the holding devices is provided with a seat, the seat being adapted to receive a pipe contacting element for holding, when the gripper is in use, the pipe contacting element, the pipe contacting element and the seat are arranged so that the pipe contacting element can be inserted into the seat in an insertion direction to enter an engagement position with the seat, in which the pipe contacting element is prevented from moving laterally to the insertion direction, and one of the pipe contacting element and the seat is provided with a notch and the other of the pipe contacting element and the seat is provided with a protrusion, arranged so that, as the pipe contacting element is inserted into the seat in the insertion direction, the protrusion enters, in parallel with the insertion direction, into the notch.

Thereby, an incorrect insertion of a pipe contacting element by an operator can be prevented. For example, where the pipe contacting element needs to be held by the gripping element in a particular orientation, installation of the pipe contacting element in an incorrect orientation can be avoided. More particularly, the incorrect orientation will provide for the notch or protrusion of the pipe contacting element to be in an incorrect position for engaging the protrusion or notch of the seat. This will result in the pipe contacting element not reaching the engagement position, since the protrusion will prevent this.

Preferably, the protrusion has a shape that is complementary to the notch.

In case the holding device is provided with a locking device as described above, the locking device can be prevented from reaching the locking position as an attempt is made by an operator to move the holding device to the operation position. More particularly, since the pipe contacting element is not fully in its engagement position, it will be in the way for the locking device, which will be stopped as it is urged to the locking position by the gripping body, and instead it will remain in the open position. Where the locking device protrudes, as suggested above, in its open position from the holding body towards the gripping body, it will prevent the holding device from reaching the operation position.

This in turn will prevent the connection arrangements to be maneuvered so as to secure the holding device to the operation position, whereby the operator will be alerted that there is an error in the assembly.

One of the seat and the pipe contacting element can present a straight groove, and the other of the seat and the pipe contacting element can present a straight ridge, wherein the ridge and the groove have shapes that are complementary to each other, such that they engage each other so that the pipe contacting element can slide in the direction of the groove and the ridge, from an entry position, in which the engagement between the pipe contacting element and the seat is initiated, to the engagement position. Preferably, the seat presents the groove in the form of a dovetail slot, and the pipe contacting element presents the dovetail shaped ridge.

Preferably, all of the holding devices are provided with a respective seat.

The objects are also reached with a combination of a holding device and a connection arrangement.

The objects are also reached with a connection apparatus comprising a device, for example a holding device as described above, and a connection arrangement adapted to releasably fasten the device to a body, for example a gripping body as described above.

The objects are also reached with a gripper comprising a plurality of gripping bodies, holding devices, and pipe contacting elements, at least one of the holding devices comprising a holding body and a locking device.

The objects are also reached with a holding device.

The objects are also reached with a gripper for gripping a pipe, comprising a plurality of gripping elements, each preferably comprising a gripping body and a holding device as described above, and a plurality of pipe contacting elements, with a notch and a protrusion.

The objects are also reached with a combination of a holding device and a pipe contacting element.

DESCRIPTION OF FIGURES

Below embodiments of the invention will be described with reference to the drawings, in which.

DETAILED DESCRIPTION

Figure 1:
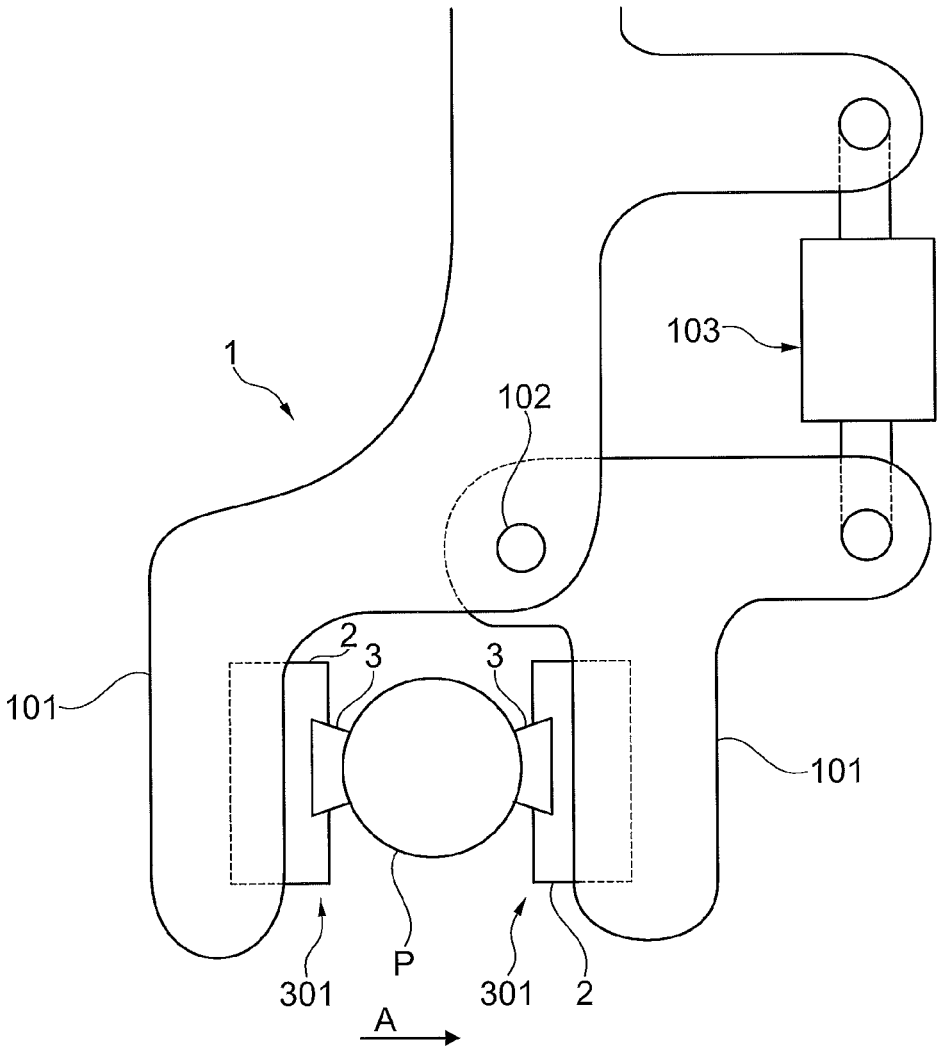
FIG. 1 shows plan view of a gripper according to an embodiment of the invention.

FIG. 1 shows an embodiment of a gripper 1 for gripping a pipe P. The gripper is used in conjunction with drilling in the ground or seabed for assembling and disassembling drill strings and borehole casings comprising a plurality of straight pipes connected end to end. Two grippers 1 are used to grip a respective pipe P to connect or disconnect the pipes at complementary threads in the pipes.

The gripper 1 comprises two gripping bodies 101 and two pipe contacting devices 301. Each pipe contacting device 301 is fastened to a respective gripping body 101. Each of the pipe contacting devices 301 comprises a holding device 2, herein also referred to as a jaw 2, and at least one pipe contacting element 3, herein also referred to as a die.

The gripping bodies 101 are connected with an articulated joint 102. The gripper comprises a drive 103 in the form of a hydraulic actuator 103. By means of the hydraulic actuator 103, the gripper 1 can rotate one of the gripping bodies 101, in relation to the other gripping body 101, about the articulated joint 102. Thereby, the gripper 1 is adapted to move the gripping bodies 101 in relation to each other so as to grip a pipe P, whereby the dies 3 are in contact with the pipe, or so as to release to the pipe.

The dies 3, or inserts as they are also sometimes referred to, are the parts that are in direct contact with the pipe P. They have a surface presenting a curvature that is identical to the curvature of the pipe to be gripped. Therefore, the dies 3 might have to be changed, for example as described below, to be adapted to pipes of various different diameters. The curved surface of the dies 3 have, as can be seen in some of the following figures, small ridges to increase the friction or the grip between the dies and the pipe P.

Each jaw 2 is releasably fastened to a respective gripping body 101 with a respective connection arrangement, described further below. When the gripper is used for gripping a pipe, the jaws 2 are in respective operation positions relative to the respective gripping bodies 101. When the gripper is in use, each jaw 2 holds a respective of the dies 3, as described closer below.

Figure 2A:
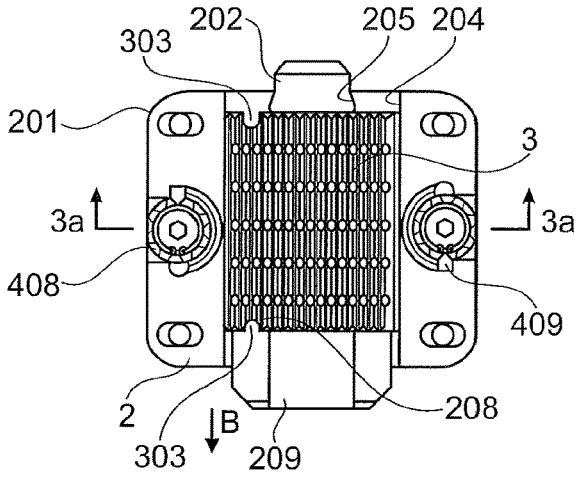
FIGS. 2A-2C show plan views of a jaw and a die in the gripper shown in FIG. 1, FIGS. 3A-3C show cross-sectional views of the jaw and the die in, respectively.
Figure 2B:
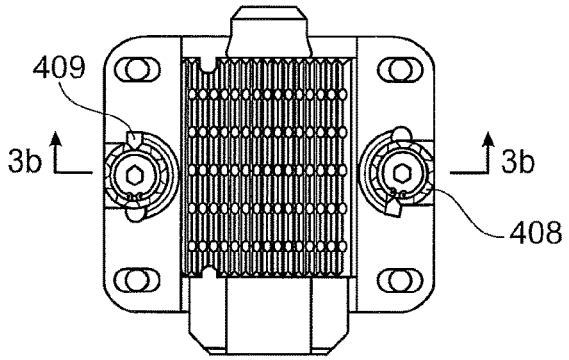
Figure 2C:
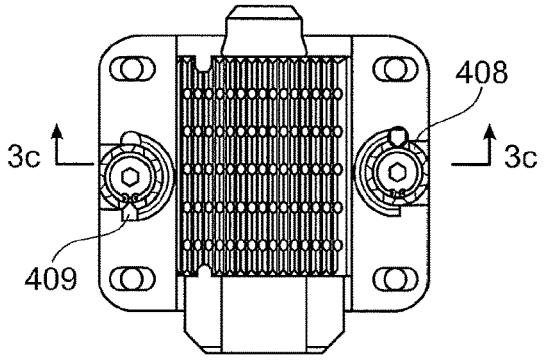
Figure 3A:
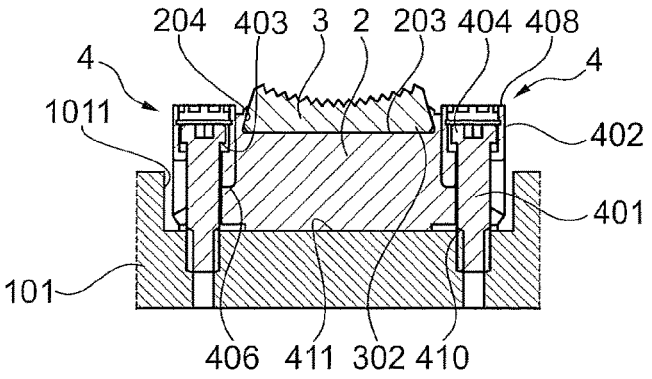
Figure 3B:
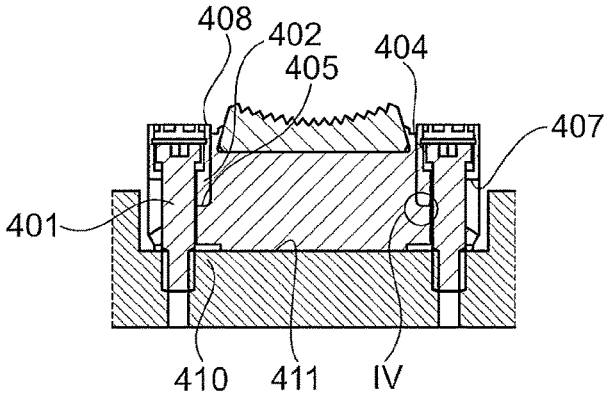
Figure 3C:
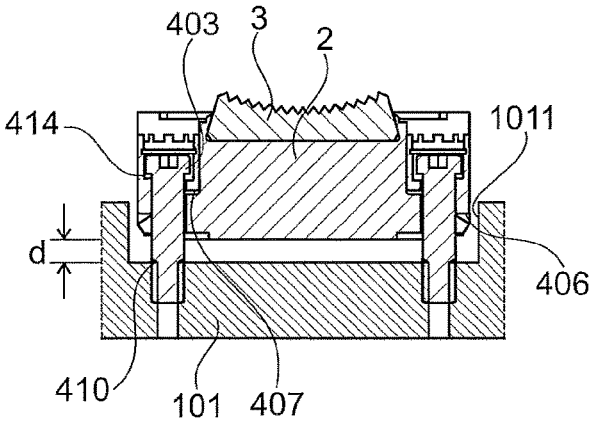

Reference is made to FIGS. 2A-2C, and to FIGS. 3A-3C. FIGS. 2A-2C show plan views of the jaw 2 and the die 3 to the right in FIG. 1. The line of view is parallel to the arrow A in FIG. 1. FIGS. 3A-3C show cross-sectional views of the jaw 2 and the die 3, with the section oriented as indicated by the arrows 3*a*-3*a*, 3*b*-3*b* and 3*c*-3*c* in FIG. 2A, FIG. 2A, FIG. 2A, respectively.

The connection arrangement 4, connecting the jaw 2 to the gripping body 101, is adapted to be maneuvered so as to release the jaw 2 from the operation position, shown in FIG. 3A, so as for the jaw to assume a service position, shown in FIG. 3C, in which it is held by the gripping body 101. In the service position of the jaw 2 the die 3 can be replaced, as described below.

In the operation position the jaw 2 is countersunk into a depression 1011 in the gripping body 101, which depression 1011 has a shape that is complementary to the external shape of the jaw 2. Thereby, very large lateral forces occurring at the time of assembling or disassembling two pipes, can be effectively transferred between the jaw 2 and the gripping body 101.

In the service position shown in FIG. 3*c*, the jaw 2 is displaced by a distance d from the operation position, in a direction away from the gripping body 101. Thereby, in the service position the jaw 2 is displaced and away from the countersunk location, so that it is at least partially emerged from the depression 1011.

The connection arrangement 4 comprises two elongated fixing devices in the form of bolts 401. The connection arrangement 4 further comprises two turnable members 402 is the form of two sleeves 402 into which the bolts are inserted. The bolts 401 are inserted through respective apertures, more specifically holes, in the jaw 2 and engaged, more specifically fixed to the gripping body 101.

Each bolt 401 presents a first flange 403, the sleeve 402 bearing against the first flange 403 so as to axially restrict the movement of the sleeve. The first flange is provided by a head 404 of the bolt, and the sleeve 402 is interposed between the head 404 and the jaw 2, and the jaw 2 is interposed between the sleeve 402 and the gripping body 101.

The jaw 2 presents a first abutment surface 405 facing in a direction which is opposite to the direction in which the bolt 401 is inserted into the gripping body 101. The sleeve 402 presents a second abutment surface 406 and a third abutment surface 407, which face in the direction in which the bolt 401 is inserted into the gripping body 101. The second abutment surface 406 and the third abutment surface 407 are mutually displaced in the axial direction. More specifically, the distance from the second abutment surface 406 to the first flange 403 is larger than the distance between the third abutment surface 407 and the first flange 403. Moreover, the second abutment surface 406 and the third abutment surface 407 are mutually displaced by 180 degrees in the circumferential direction of the sleeve 402.

The sleeve 402 is provided with a free end 408 which is located opposite to the first and second abutment surfaces 406, 407. As can be seen also in FIGS. 2A-2C, the free end 408 is slotted that it can be engaged by a handheld tool for turning the sleeve 402. Upon the sleeve 402 assuming in relation to the jaw 2 a first angular position, shown by the indicator 409 in FIG. 2A, the first abutment surface 405 abuts against the second abutment surface 406 whereby the jaw 2 is biased into the operation position. Thereby, the second abutment 406 surface of the sleeve 402 is in a blocking position in which it prevents the jaw 2 from moving away from the operation position.

When the sleeve is turned by the handheld tool, so as to assume in relation to the jaw a second angular position, shown by the indicator 409 in FIG. 2*c*, the first abutment surface 405 abuts against the third abutment surface 407 whereby the jaw can be moved into the service position shown in FIG. 3C. Thus, when the sleeve 402 is turned the second abutment surface 406 moves away from the blocking position thereby allowing the jaw 2 to move, along longitudinal axes of the bolts 401, away from the operation position. In the service position the bolts 401 support the jaw 2.

As can be seen in FIGS. 3A-3C, each bolt 401 presents a second flange 410 bearing against the gripping body 101. This will define the length of insertion of the bolt into the gripping body, and it will provide a predetermined distance between the first flange 403 and a region 411 of abutment of the jaw to the gripping body.

Figure 4:
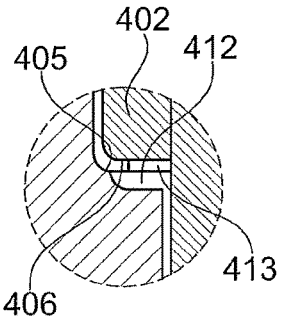
FIG. 4 shows a detail in FIG. 3B marked with the circle IV.

A can be seen in FIG. 4, the first abutment surface 405 is provided with a notch 412 and the second abutment surface 406 is provided with a protrusion 413 having a shape that is complementary to the notch 412. Thereby, upon engagement of the protrusion 413 with the notch 412, angular movement of the sleeve 402 is prevented, and the sleeve is kept in the first angular position.

An elastic element in the form of a wave washer 414 is provided between the sleeve 402 and the first flange 403. Thereby, the protrusion 413 will be biased into the notch 412. When turning the sleeve with the handheld tool towards the second angular position, the protrusion 413 is urged out of the notch 412, the wave washer 414 is compressed, the sleeve is moved slightly away from the gripping body 101, and the protrusion 413 is allowed to exit the notch 412.

Figure 5A:
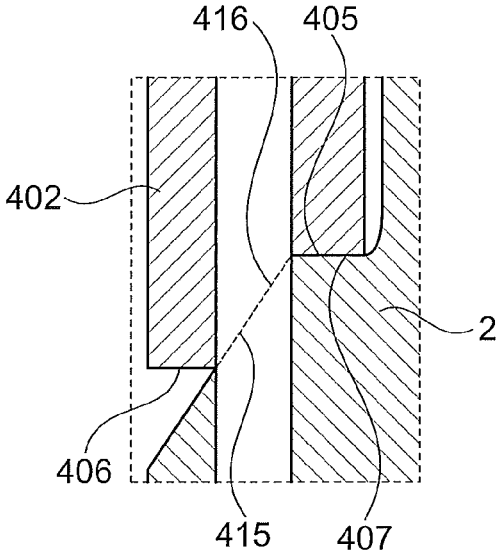
FIG. 5A shows a detail of FIG. 3A.

FIG. 5A shows a schematic detail of the cross-section in FIG. 3C, showing how in the second angular position of the sleeve 402, the first abutment surface 405 of the jaw 2 abuts against the third abutment surface 407 of the sleeve. It can also be seen that the sleeve presents an angled surface 415 between the second and third abutment surfaces 406, 407. The angled surface 415 is adapted to cooperate with a similarly angled surface 416 on the jaw 2, for pushing the jaw, when the sleeve 402 is turned, from the service position towards the operation position.

Figure 5B:
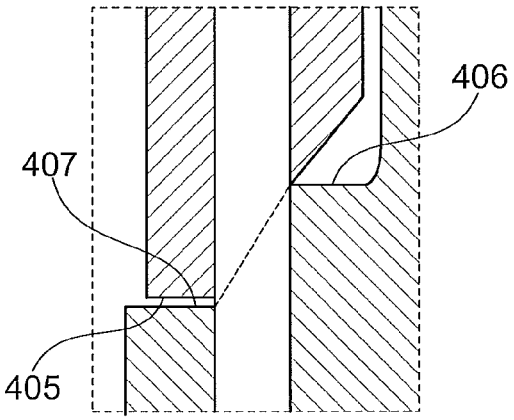
FIG. 5B shows a detail corresponding to the detail in FIG. 5A, but with some features being different.

FIG. 5B shows an alternative embodiment where the first abutment surface is presented by the sleeve 402, and the jaw presents the second and third abutment surfaces 406, 407. In FIG. 5B, the sleeve 402 is in the second angular position, and the first abutment surface 405 of the sleeve 2 abuts against the third abutment surface 407 of the jaw.

Reference is made to FIG. 3A. The jaw 2 is provided with a seat 203 for holding the die 3. The seat 203 presents a groove in the form of a dovetail slot 204, and the die 3 presents the dovetail shaped ridge 302. In this embodiment the ridge 302 forms a major part of the die 3 itself. In FIG. 2A the die is shown in an engagement position in relation to the jaw 2, which is the position which the die assumes during operation of the gripper. By means of the slot 204 and the ridge 302 the die 3 can be inserted into the seat 203 in an insertion direction, indicated in FIG. 2A with an arrow B, to enter an engagement position with the seat, in which the die is prevented from moving laterally to the insertion direction.

Figure 6:
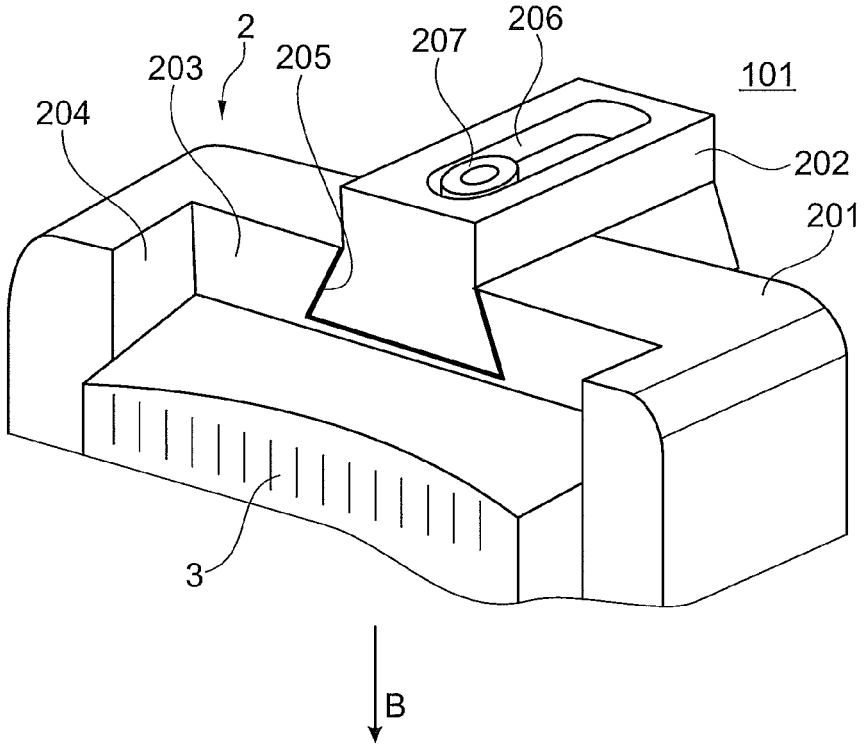
FIG. 6 shows a perspective view of the top part of the jaw and the die in FIGS. 2A-2C, FIGS. 7A-7B show plan views of another jaw and another die in the gripper shown in FIG. 1.

Reference is made to FIGS. 2, 3A and 6. The jaw 2 comprises a holding body 201 and a locking device 202. The locking device is provided in a dovetail slot 205 presented by the holding body 201, which dovetail slot 205 extends perpendicularly to the insert direction B and the dovetail slot 204 of the seat 203.

The locking device 202 can assume in relation to the holding body 201 an open position, shown in FIG. 6, in which the die 3 can be removed from the jaw 2, and a locking position in which the die is locked to the jaw 2. For this the locking device 202 presents a guide slot 206 by which is it engaged with a bolt 207 fixed to the holding body 201. When the locking device 202 is in the open position indicated in FIG. 6, the bolt 207 is at one end of the guide slot 206, and when the locking device 202 is in the locking position, the bolt 207 is at the other end of the guide slot 206. In the open position shown in FIG. 6, the locking device 202 protrudes from the "backside" of the holding body 201, i.e. it protrudes from the holding body towards the gripping body 101, and as the jaw 2 is moved towards the operation position, i.e. towards the gripping body 101, the gripping body 101 will push the locking device 202 to the locking position.

In the locking position, the locking device 202 protrudes into the dovetail slot 204 of the seat 203 for the die 3, and thereby prevents a movement of the die out of the seat, i.e. in a direction opposite to the insert direction B. In the operation position of the jaw 2, the locking device 202 is prevented by the gripping body 101 from moving out of the locking position. Thereby, it is secured that the locking device 202 is in the locking position when the jaw 2 is in the operation position.

When the gripper 1 is not in use, the die 3 can be removed from the jaw 2, e.g. to be changed or serviced. For this the jaw 2 is moved away from the operation position by turning the sleeves 402 of the connection arrangement, as described above. Thereby a distance is created between the jaw 2 and the gripping body 101, such that the locking device 202 is free to assume the open position, and the die 3 can be removed from the jaw 2.

Reference is made to FIG. 2A. The die 3 is provided with a notch 303 and the seat 204 is provided with a complementarily shaped protrusion 208, arranged so that, as the die is inserted into the seat in the insertion direction, the protrusion enters, in parallel with the insertion direction, into the notch.

Figure 7A:
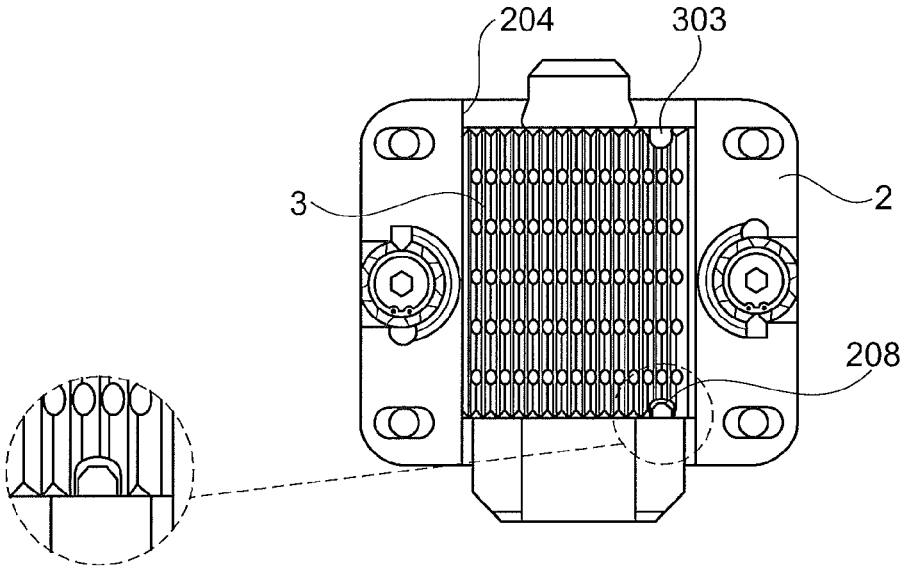

FIG. 7A shows a plan view of the jaw 2 and the die 3 to the left in FIG. 1. It can be seen that the protrusions 208 of the left and right jaws 2 are offset in opposite directions from the center of the respective seats 204. The dies 3 are however identical, but due to the design of the gripper, the dies 3 need to be inserted in opposite orientations depending on which jaw 2 they are inserted into. Each of the dies 3 presents two notches 303 located at opposite ends of the dies. The notches 303 of each die 3 are offset such that one of them can mate with the protrusion in one of the jaws 2 and the other notch can mate with the protrusion of the other jaw.

Figure 7B:
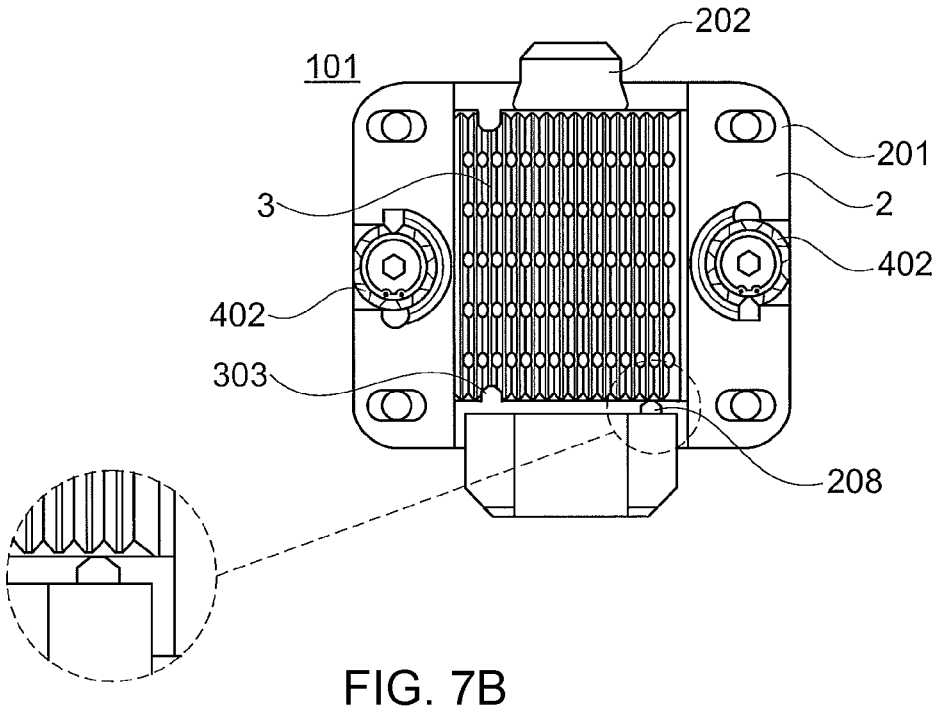

As illustrated by FIG. 7B, if an attempt is made to insert a die 3 in an incorrect orientation, the notch 303 will be offset in a direction which is opposite to the direction in which the protrusion 208 is offset, and this will result in the die 3 not reaching the engagement position, since the protrusion 208 will prevent this. This also means that the locking device 202 will be prevented from reaching the locking position as an attempt is made by an operator to move the jaw 2 to the operation position. More particularly, since the locking device protrudes, as described above, in its open position from the holding body 201 towards the gripping body 101, it will prevent the jaw 2 from reaching the operation position.

This in turn will prevent the sleeves 402 to be turned, whereby the operator will be alerted that there is an error in the assembly.

Figure 8:
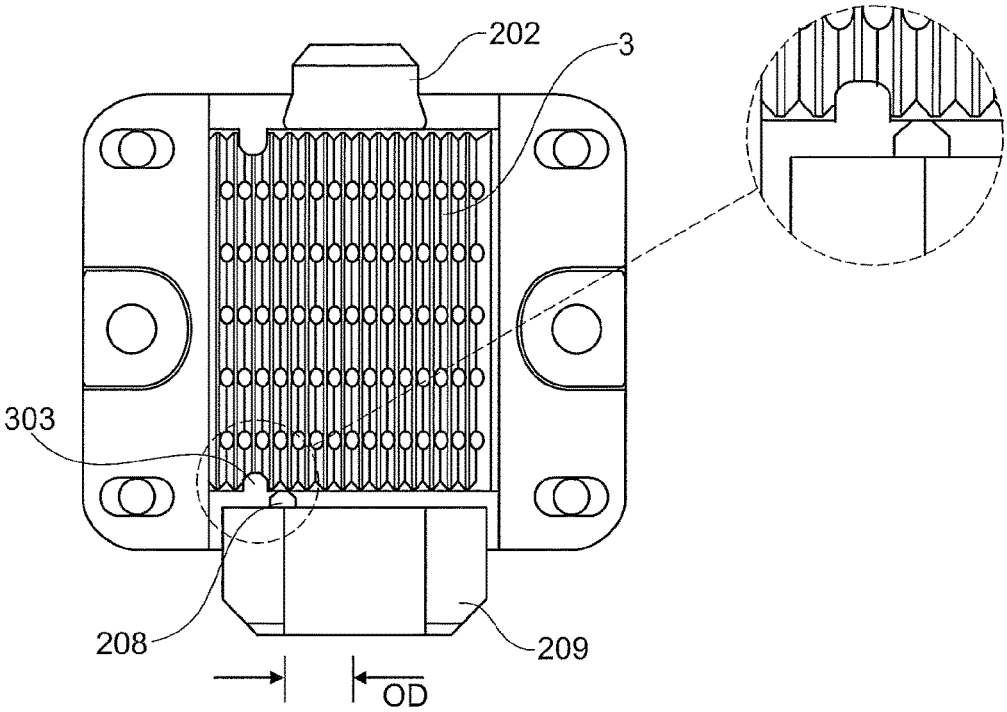
FIG. 8 shows a plan view the jaw and the die in FIG. 2A, with a part replaced on the jaw.

Reference is made to FIGS. 2A and 8. The jaw 2 presents a removable die abutment element 209 presenting the protrusion 208. The die abutment element 209 can be replaced by another die abutment element 209 shown in FIG. 8, in which the offset distance OD of the protrusion 208 is different from the offset distance of the protrusion 208 in FIG. 2A. Furthermore, die abutment element 209 in FIG. 8 is adapted for a die that is intended to grip pipe with a different pipe diameter, and therefore the die has a pipe contacting surface curvature that is different from the corresponding curvature of the die in FIG. 2A. As can be seen in FIG. 8, if an attempt is nevertheless made to insert a die with an incorrect pipe contacting surface curvature, the offset distance of the notch 303 of the die 3 will be different from the offset distance of the protrusion. Therefore, similarly as to what was described above with reference to FIG. 7B, the die 3 will not reach the engagement position, the locking device 202 will be prevented from reaching the locking position, and this will prevent the jaw 2 from reaching the operation position, whereby the operator will be alerted when the sleeves cannot be turned that there is an error in the assembly.

Alternatively, the die can present the protrusion and the jaw can present the notch.

Figure 9:
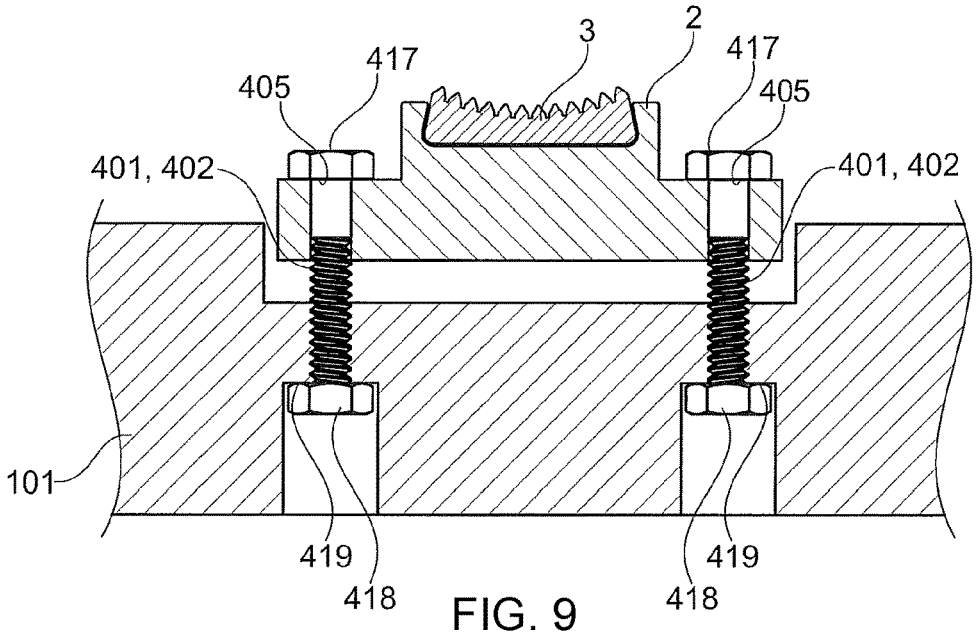
FIGS. 9 and 10 show cross-sectional views corresponding to the one shown in FIG. 3C, of alternative embodiments of the invention.

Reference is made to FIG. 9 depicting an alternative embodiment of the invention. The die 2 is shown in a service position similarly to as shown in FIG. 3C. In this embodiment, two bolts 401, 402 provide the functions of the bolts 401 as well as the sleeves 402 in the embodiment described with reference to FIG. 3C. The bolts 401, 402 are the inserted through respective apertures, more specifically holes, in the jaw 2 and threaded into the gripping body 101.

Each bolt 401, 402 presents an abutment surface 405 formed by a bolt head 417. The abutment surface 405 assumes, upon turning the bolt 401, 402 so that it is threaded into the gripping body 101 and pushes the jaw 2 into the operation position, a blocking position in which it prevents the jaw 2 from moving away from the operation position. Upon turning the bolts 401, 402 so that they are threaded out of the gripping body 101, the abutment surfaces 405 moves away from their blocking positions thereby allowing the jaw 2 to move away from the operation position.

Each bolt 401, 402 is provided, in the end thereof opposite to the end at which the bolt head 417 is provided, with a stop nut 418, which is welded onto the bolt end. The stop nuts 418 prevent unthreading the bolts 401, 402 further than what is required for the jaw to reach the service position, in which the jaw is supported by the bolts 401, 402. For this, the gripping body 101 presents stop surfaces 419 to which the stop nuts 418 come into contact when the bolts 401, 402 are threaded out of the gripping body 101 by turning the bolt heads 417.

Figure 10:
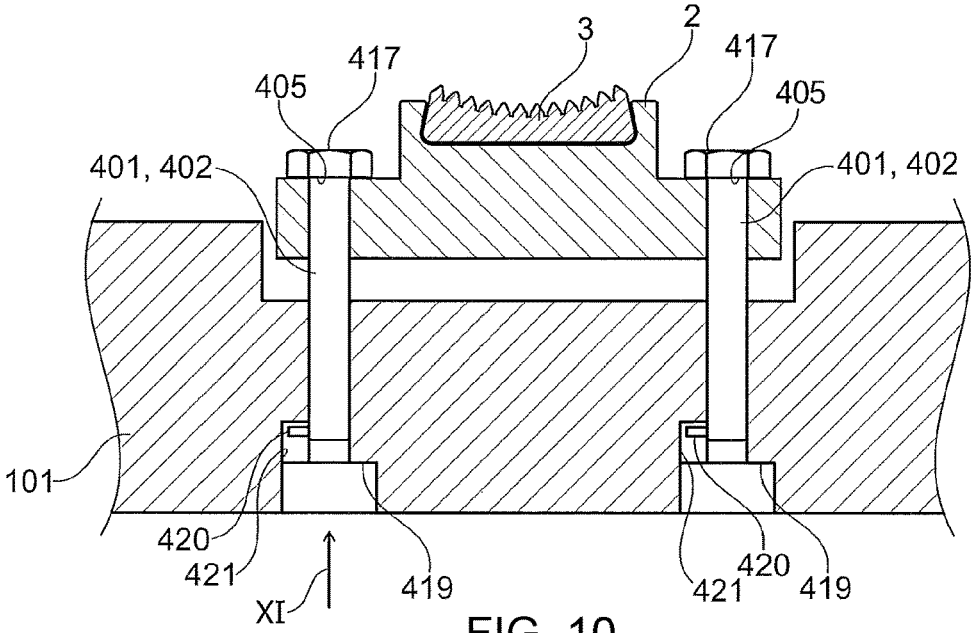
Figure 11:
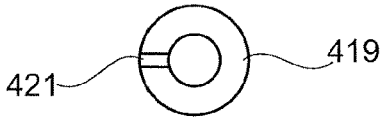
FIG. 11 shows a view as indicated by the arrow XI in FIG. 10.

Reference is made to FIGS. 10 and 11 depicting a further embodiment of the invention. Similarly to the embodiment shown in FIG. 9, two pins 401, 402 provide the functions of the bolts 401 as well as the sleeves 402 in the embodiment described with reference to FIG. 3*c*. The pins 401, 402 are the inserted through respective holes in the jaw 2 and holes in the gripping body 101.

Each pin 401, 402 presents an abutment surface 405 formed by a pin head 417. Each pin 401, 402 is provided, in the end thereof opposite to the end at which the pin head 417 is provided, with a locking rod 420 extending from the pin 401, 402, perpendicularly thereto. In the service position of the jaw 2 shown in FIG. 10, the locking rods 420 are located in respective cuts 421 in the gripping body 101; see also FIG. 11

In the operation position of the jaw 2 the pins 401, 402 are pushed into the gripping body 101 so that the locking rods 420 exit the cuts 421. The pins 401, 402 are also turned so that the locking rods 420 are moved away from the cuts 421. Thereby, the locking rods 420 lock the pins 401, 402 axially by abutment against respective stop surfaces 419 of the gripping body 101.

Upon turning the pins 401, 402 so that the locking rods 420 enter the cuts 421, the pins 401, 402 can be pulled out of the gripping body 101 they are threaded out of the gripping body 101. Thereby, the abutment surfaces 405 move away from their blocking positions thereby allowing the jaw 2 to move away from the operation position. The depth of the cuts 421 are such that they prevent the pins 401, 402 exiting further than what is required for the jaw 2 to reach the service position, in which the jaw is supported by the pins 401, 402.

The invention claimed is:

1. A gripper for gripping a pipe, comprising:

a plurality of gripping bodies and holding devices, each holding device being, when the gripper is in use, fastened to one of the gripping bodies with a respective connection arrangement in an operation position relative to the respective gripping body;

the gripper further comprising a plurality of pipe contacting elements, each holding device holding, when the gripper is in use, at least one of the pipe contacting elements; and the gripper being adapted to move the gripping bodies in relation to each other so as to grip a pipe, whereby the pipe contacting elements are in contact with the pipe, or so as to release to the pipe, wherein the connection arrangements are adapted to be maneuvered so as to release the respective holding device from the operation position so as for the holding device to assume a service position in which the respective holding device is displaced from the operation position and held by the respective gripping body, wherein each connection arrangement comprises a turnable member adapted to lock, by engagement of the connection arrangement with the gripping body, the holding device in the operation position, the turnable member further being adapted to be turned and thereby release the holding device from the operation position, and wherein the turnable member presents an abutment surface and is arranged so that the abutment surface can assume a blocking position in which the abutment surface prevents the holding device from moving away from the operation position, the turnable member further being arranged so that upon turning the turnable member the abutment surface moves away from the blocking position thereby allowing the holding device to move away from the operation position.

2. The gripper according to claim 1, wherein each connection arrangement is adapted to engage the respective gripping body, whereby the connection arrangement is adapted to support the holding device in the service position.

3. The gripper according to claim 1, wherein each connection arrangement comprises a fixing device extending through an aperture in the holding device and being engaged with the gripping body.

4. The gripper according to claim 3, wherein the fixing device is arranged to support the holding device in the service position.

5. The gripper according to claim 4, wherein the fixing device is elongated, whereby the holding device is arranged to be moved from the operation position to the service position along a longitudinal axis of the fixing device.

6. A gripper for gripping a pipe, comprising:

a plurality of gripping bodies and holding devices, each holding device being, when the gripper is in use, fastened to one of the gripping bodies with a respective connection arrangement in an operation position relative to the respective gripping body;

the gripper further comprising a plurality of pipe contacting elements, each holding device holding, when the gripper is in use, at least one of the pipe contacting elements; and the gripper being adapted to move the gripping bodies in relation to each other so as to grip a pipe, whereby the pipe contacting elements are in contact with the pipe, or so as to release to the pipe, wherein the connection arrangements are adapted to be maneuvered so as to release the respective holding device from the operation position so as for the holding device to assume a service position in which the respective holding device is displaced from the operation position and held by the respective gripping body, wherein each connection arrangement comprises a turnable member adapted to lock, by engagement of the connection arrangement with the gripping body, the holding device in the operation position, the turnable member further being adapted to be turned and thereby release the holding device from the operation position, and wherein each connection arrangement comprises a fixing device extending through an aperture in the holding device and being engaged with the gripping body, and the turnable member is a sleeve through which the fixing device extends, the fixing device being fixed to the gripping body.

7. A gripper for gripping a pipe, comprising:

a plurality of gripping bodies and holding devices, each holding device being, when the gripper is in use, fastened to one of the gripping bodies with a respective connection arrangement in an operation position relative to the respective gripping body;

the gripper further comprising a plurality of pipe contacting elements, each holding device holding, when the gripper is in use, at least one of the pipe contacting elements; and the gripper being adapted to move the gripping bodies in relation to each other so as to grip a pipe, whereby the pipe contacting elements are in contact with the pipe, or so as to release to the pipe, wherein the connection arrangements are adapted to be maneuvered so as to release the respective holding device from the operation position so as for the holding device to assume a service position in which the respective holding device is displaced from the operation position and held by the respective gripping body, wherein each connection arrangement comprises an elongated fixing device, and a sleeve into which the fixing device is inserted, the fixing device being inserted through an aperture in the holding device and fixed to the gripping body;

the fixing device presents a first flange, the sleeve being adapted to bear against the first flange so as to axially restrict the movement of the sleeve;

one of the sleeve and the holding device presents a first abutment surface, and the other of the sleeve and the holding device presents a second abutment surface and a third abutment surface, the second abutment surface and the third abutment surface being mutually displaced in the axial direction and in the circumferential direction of the sleeve;

the first abutment surface is adapted to abut, upon the sleeve assuming a first angular position in relation to the holding device, against the second abutment surface whereby the holding device is locked in the operation position; and the first abutment surface is adapted to abut, when the sleeve is turned so as to assume a second angular position, against the third abutment surface whereby the holding device can be moved into the service position.

8. A gripper for gripping a pipe, comprising:

a plurality of gripping bodies and holding devices, each holding device being, when the gripper is in use, fastened to one of the gripping bodies with a respective connection arrangement in an operation position relative to the respective gripping body;

the gripper further comprising a plurality of pipe contacting elements, each holding device holding, when the gripper is in use, at least one of the pipe contacting elements; and the gripper being adapted to move the gripping bodies in relation to each other so as to grip a pipe, whereby the pipe contacting elements are in contact with the pipe, or so as to release to the pipe, wherein the connection arrangements are adapted to be maneuvered so as to release the respective holding device from the operation position so as for the holding device to assume a service position in which the respective holding device is displaced from the operation position and held by the respective gripping body, wherein at least one of the holding devices comprises a holding body and a locking device, which locking device can assume in relation to the holding body an open position in which a pipe contacting element, held by the holding device, can be removed from the holding device, and a locking position in which the pipe contacting element is locked to the holding device, and wherein the locking device is adapted to be kept, by contact with the respective gripping body, in the locking position when the holding device is in the operation position, and that the locking device is free to move to the open position when the holding device is moved away from the operation position.

9. A gripper for gripping a pipe, comprising:

a plurality of gripping bodies and holding devices, each holding device being, when the gripper is in use, fastened to one of the gripping bodies with a respective connection arrangement in an operation position relative to the respective gripping body;

the gripper further comprising a plurality of pipe contacting elements, each holding device holding, when the gripper is in use, at least one of the pipe contacting elements; and the gripper being adapted to move the gripping bodies in relation to each other so as to grip a pipe, whereby the pipe contacting elements are in contact with the pipe, or so as to release to the pipe, wherein the connection arrangements are adapted to be maneuvered so as to release the respective holding device from the operation position so as for the holding device to assume a service position in which the respective holding device is displaced from the operation position and held by the respective gripping body, wherein at least one of the holding devices is provided with a seat, the seat being adapted to receive a pipe contacting element for holding, when the gripper is in use, the pipe contacting element;

the pipe contacting element and the seat are arranged so that the pipe contacting element can be inserted into the seat in an insertion direction to enter an engagement position with the seat, in which the pipe contacting element is prevented from moving laterally to the insertion direction; and one of the pipe contacting element and the seat is provided with a notch and the other of the pipe contacting element and the seat is provided with a protrusion, arranged so that, as the pipe contacting element is inserted into the seat in the insertion direction, the protrusion enters, in parallel with the insertion direction, into the notch.

10. A gripper for gripping a pipe, comprising:

a plurality of gripping bodies and holding devices, each holding device being, when the gripper is in use, releasably fastened to one of the gripping bodies in an operation position relative to the respective gripping body;

the gripper further comprising a plurality of pipe contacting elements, each holding device holding, when the gripper is in use, at least one of the pipe contacting elements;

the gripper being adapted to move the gripping bodies in relation to each other so as to grip a pipe, whereby the pipe contacting elements are in contact with the pipe, or so as to release to the pipe; and at least one of the holding devices comprising a holding body and a locking device, which locking device can assume in relation to the holding body an open position in which a pipe contacting element, held by the holding device, can be removed from the holding device, and a locking position in which the pipe contacting element is locked to the holding device, wherein the locking device is adapted to be kept, by contact with the respective gripping body, in the locking position when the holding device is in the operation position, and that the locking device is free to move to the open position when the holding device is moved away from the operation position; and wherein the holding device is provided with a seat for holding the pipe contacting element, whereby the pipe contacting element can be inserted into the seat in an insertion direction, the locking device blocking in the locking position the path in the insert direction of the pipe contacting element so as to prevent removal of the pipe contacting element from the seat, and the locking device being in the open position removed from the path in the insert direction of the pipe contacting element so as to allow the removal of the pipe contacting element from the holding device.

11. The gripper according to claim 10, wherein the locking device is arranged to move, by contact with the respective gripping body, to the locking position as the holding device is moved into the operation position.

12. The gripper according to 10, wherein each holding device comprises one locking device for each pipe contacting element.

* * * * *